US007516876B2

(12) United States Patent
Ohmori

(10) Patent No.: US 7,516,876 B2
(45) Date of Patent: Apr. 14, 2009

(54) DRIVING MACHINE FOR DRIVING AFASTENER MEMBER INTO A MEMBER TO BE FASTENED USING A PROBE TO LOCATE THE FASTENING MEMBER

(75) Inventor: Yasuki Ohmori, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/680,117

(22) Filed: Feb. 28, 2007

(65) Prior Publication Data

US 2007/0215665 A1 Sep. 20, 2007

(30) Foreign Application Priority Data

Mar. 16, 2006 (JP) ..... P2006-073418

(51) Int. Cl.
*B02C 1/04* (2006.01)

(52) U.S. Cl. ..... 227/119; 227/8; 227/10; 227/110; 227/130

(58) Field of Classification Search ..... 227/119, 227/130, 110, 8, 10
See application file for complete search history.

(56) References Cited

U.S. PATENT DOCUMENTS 5,452,835 A * 9/1995 Shkolnikov ..... 227/8
6,279,808 B1 * 8/2001 Larsen ..... 227/119
6,789,718 B2 * 9/2004 Canlas et al. ..... 227/130
6,808,101 B2 * 10/2004 Laubach et al. ..... 227/109

FOREIGN PATENT DOCUMENTS

| | | |
|---|---|---|
| JP | 6-190745 | 7/1994 |
| JP | 7-53907 | 12/1995 |
| JP | 8-52666 | 2/1996 |

* cited by examiner

*Primary Examiner*—Rinaldi I. Rada
*Assistant Examiner*—Michelle Lopez
(74) *Attorney, Agent, or Firm*—Mattingly, Stanger, Malur & Brundidge, P.C.

(57) ABSTRACT

A driving machine has a work contact portion with an end face to be contacted with a member to be fastened that is provided in a push lever, and a probe movably provided on the work contact portion, wherein the probe is energized in the driving direction by a spring to thereby project its leading end portion from the end face of the work contact portion. When the main body of the driving machine is pressed against a work, the probe is retreated from the driving passage of a fastening member when a tripper switch is operated.

7 Claims, 7 Drawing Sheets

DRIVING MACHINE FOR DRIVING AFASTENER MEMBER INTO A MEMBER TO BE FASTENED USING A PROBE TO LOCATE THE FASTENING MEMBER

BACKGROUND

1. Technical Field

The present invention relates to a driving machine such as a nail driving machine which is used to drive a fastening member such as a nail into a member to be driven through a hole formed in a member to be fastened.

2. Description of Related Art

Like a nail driving machine which drives a piston using air pressure, combustion pressure or the like to strike a nail through a hole formed in a connecting metal member such as a member to be fastened, there is known a driving machine which drives a nail or the like into a previously determined hole positively; and, conventionally, as driving machines of this kind, there are proposed various types of driving machines.

For example, as a power type nail driving machine, there are known several nail driving machines: one of them is a driving machine including a mechanism which, in order to align the axis of a nail driving portion, that is, the axis of a nail with a hole formed in a connecting metal member, holds the leading end of the nail to be driven in such a manner that the nail leading end is projected beyond the leading end of a tool, and inserts the leading end of the nail into the hole of the connecting metal member to thereby align the axis of the nail with the hole; and, another is a driving machine including a mechanism in which the leading end of a push lever well known as a safety device is formed in a sharp angle half cut tapered shape, the tapered leading end is previously aligned with the axis of a nail to be driven, and the tapered leading end is inserted into a hole formed in a connecting metal member to thereby align the nail with the hole.

In the former nail driving machine, since the leading end of the nail is held in a nail drive and hold portion in a projecting manner before the nail is driven, it is necessary to set a complicated safety mechanism different from an ordinary conventional nail driving machine: for example, besides a piston used to drive the nail into a work, a sub piston used to drive the leading one of two or more nails connected together by a connecting belt into the nail drive and hold portion after the connecting belt is broken; and, a bill-shaped guide portion which can be opened and closed and is used to hold the nail in the leading end of the nail drive portion. Owing to this, the main body of the nail driving machine is large in size and heavy in weight, the operation efficiency of the nail driving machine is worsened, and the manufacturing cost thereof is increased.

FIGS. 10 and 11 respectively show the structure of the nail guide portion of the latter of the above-mentioned conventional nail driving machines.

FIG. 10 is a partial section view of the nail guide portion, showing a state in which the axis of a nail 41 is aligned with a hole H formed in a connecting metal member K. The other remaining portions of the structure of the nail driving machine are the same as a conventionally known ordinary nail driving machine.

As shown in FIG. 10, on the leading end of a push lever 109, there is pivotally mounted, by a pin 180, a probe 178 having a shape obtained by half cutting a tubular body longitudinally in such a manner that the probe 178 can be rotated only in an allowable angle range, while the leading end 176 of the probe 178 is formed in a sharp angle tapered shape. And, in the inner peripheral surface of the probe 178, there is formed a guide groove 181 which is used to guide the nail 41.

Thus, when the tapered portion of the leading end 176 of the probe 178 is aligned with the hole H of the connecting metal member K and the main body of the nail driving machine is pressed against the tapered portion, the axis of the nail 41 to be driven can be aligned with the hole H. After then, when a trigger switch (not shown) is turned on, as shown in FIG. 11, the nail 41 is struck out by a piston (not shown) and is lowered down (FIG. 11 shows a state in which the leading end of the nail 41 starts to touch a work W, namely, a member into which the nail 41 is driven).

The nail 41 is guided while the leading end side thereof is in contact with the guide groove 181 formed in the inner peripheral surface of the probe 178, and the nail 41 lowers down while spreading the probe 178 outwardly from the axis of the nail 41. Since there occurs in the nail driving machine an instantaneous float due to a reaction caused when the nail driving machine is started, the leading end 176 of the probe 178 slips from the corner of the hole H of the connecting metal member K on the tapered surface of the leading end 176 of the probe 178 and departs from the hole H of the connecting metal member K, whereby the nail 41 moves into the hole H of the connecting metal member K in alignment with the hole H.

And, when the nail 41 moves down further, the head of the nail 41 is contacted with the guide groove 181 of the probe 178 and thus the nail 41 spread the probe 178 further, so that the nail 41 is driven completely until the head thereof is contacted with the connecting metal member K.

As described above, since the latter conventional nail driving machine has a structure in which a probe composed of a sharp angle half cut tapered part is simply added to the leading end of the push lever of a conventional ordinary nail driving machine, the latter nail driving machine has not such a problem like the former nail driving machine that the main body of the nail driving machine is large in size and heavy in weight.

By the way, nail driving machines of this type are disclosed in, for example, JP-UM-Hei-7-053907, JP-A-Hei-6-190745, and JP-A-Hei-8-052666.

SUMMARY

However, in the above-mentioned latter conventional nail driving machine, each time the nail 41 is driven, the nail 41 is heavily collided with the guide groove 181 of the probe 178. Generally, the nail driving speed is about 20 m/s which is a high speed and, therefore, when driving the nail 41, an impact due to the collision of the nail is large.

Also, because the diameter of the hole H of the connecting metal member K is of the order of Φ3 mm~Φ4 mm, and also in order that the leading end 176 of the probe 178 can be inserted into the hole H and the front portion of the nail driving machine main body can be seen easily and the operation efficiency thereof can be enhanced, the probe 178 cannot be made large (large in thickness) so much. This raises a problem that the impact strength of the probe 178 is not sufficient and thus the probe 178 is easy to break. When the probe 178 is broken, the nail driving operation must be stopped for repair and the broken probe must be replaced with a new probe using other manually-operated tool. That is, the nail driving operation must be stopped frequently, resulting in the poor operation efficiency.

The present invention aims at eliminating the above-mentioned problems found in the conventional nail driving machines. Thus, it is an object of the invention to provide a driving machine which not only can prevent the breakage of a probe and can extend the life of the probe but also can enhance the operation efficiency of the driving machine and can reduce the part replacement cost thereof.

In attaining the above object, according to the invention as set forth in claim 1, there is provided a driving machine for driving a fastening member into a member to be driven by operating a trigger switch, comprising a push lever movable in a driving direction and energizing means for energizing the push lever in the driving direction, wherein a contact portion including an end face to be contacted with a member to be fastened is provided in the push lever, a probe is movably provided in the contact portion, the probe is energized in the driving direction by energizing means to thereby project its leading end portion from the end face of the contact portion, and, in a state where the main body of the driving machine is pressed against the member to be driven, the trigger switch is operated and the probe is retreated from the driving passage of a fastening member in linking with the operation of the trigger switch.

According to the invention as set forth in claim 2, in the invention as set forth in claim 1, a guide groove is formed in the contact portion, and the probe is moved parallel to the driving direction along the guide groove with respect to the contact portion and is moved obliquely to thereby retreat the probe from the driving passage of the fastening member.

According to the invention as set forth in claim 3, in the invention as set forth in claim 1, a guide groove is formed in the probe, and the probe is moved parallel to the driving direction along the guide groove with respect to the contact portion and is moved obliquely to thereby retreat the probe from the driving passage of the fastening member.

According to the invention as set forth in claim 4, in the invention as set forth in claim 2 or 3, the guide groove is composed of two guide grooves formed in the driving direction.

According to the invention as set forth in claim 5, in the invention as set forth in any one of claims 2 to 4, by transmitting the operation of the trigger switch to the probe through transmission means, the probe is moved along the guide grooves.

According to the invention as set forth in claim 6, in the invention as set forth in any one of claims 1 to 5, the retreat of the probe from the driving passage of the fastening means is completed before starting to drive the fastening means by operating the trigger switch.

According to the invention as set forth in claim 7, in the invention as set forth in any one of claims 1 to 6, the energizing force of first emerging means for energizing the probe is smaller than the energizing force of second energizing means for energizing the push lever.

According to the invention as set forth in claim 1, in the initial state, the leading end portion of the probe is projected from the end face of the contact portion and, when the trigger switch is operated with the main body of the driving machine pressed against the member to be driven, the probe is retreated from the driving passage of the fastening member in linking with the operation of the trigger switch. Thanks to this, during the driving operation of the fastening member, the fastening member is prevented from touching the probe. Therefore, there is no possibility that any impact can be applied to the probe. This not only can prevent the probe against breakage and thus can extend the life of the probe but also, due to elimination of the need for replacement of the broken probe, can enhance the operation efficiency of the driving machine and reduce the cost of the part replacement thereof.

According to the invention as set forth in claims 2 and 3, the probe can be positively retreated from the driving passage of the fastening member along the guide groove formed in the contact portion or in the probe.

According to the invention as set forth in claim 4, since there are formed two guide grooves in the driving direction, by moving the probe parallel to the driving direction, the probe can be positively retreated from the driving passage of the fastening member.

According to the invention as set forth in claim 5, by moving the probe along the guide groove(s) in linking with the operation of the trigger switch when driving the fastening member, the probe can be retreated from the driving passage of the fastening member. This can enhance the operation efficiency of the driving machine.

According to the invention as set forth in claim 6, since the retreat of the probe from the driving passage of the fastening member is completed by operating the trigger switch before starting to drive the fastening member, during the driving operation of the fastening member, the fastening member can be positively prevented from touching the probe, which can prevent the probe against breakage and thus can extend the life of the probe.

According to the invention as set forth in claim 7, since the energizing force (spring constant) of the first energizing means (spring) for energizing the probe is smaller than the energizing force (spring constant) of the second energizing means (spring) for energizing the push lever, simply by operating the trigger switch lightly with a finger, the probe can be moved and retreated from the driving passage of the fastening member.

DESCRIPTION OF THE EMBODIMENTS

Now, description will be given below of an embodiment of the invention in which the invention is applied to a combustion-type nail driving machine with reference to the accompanying drawings.

Figure 1:
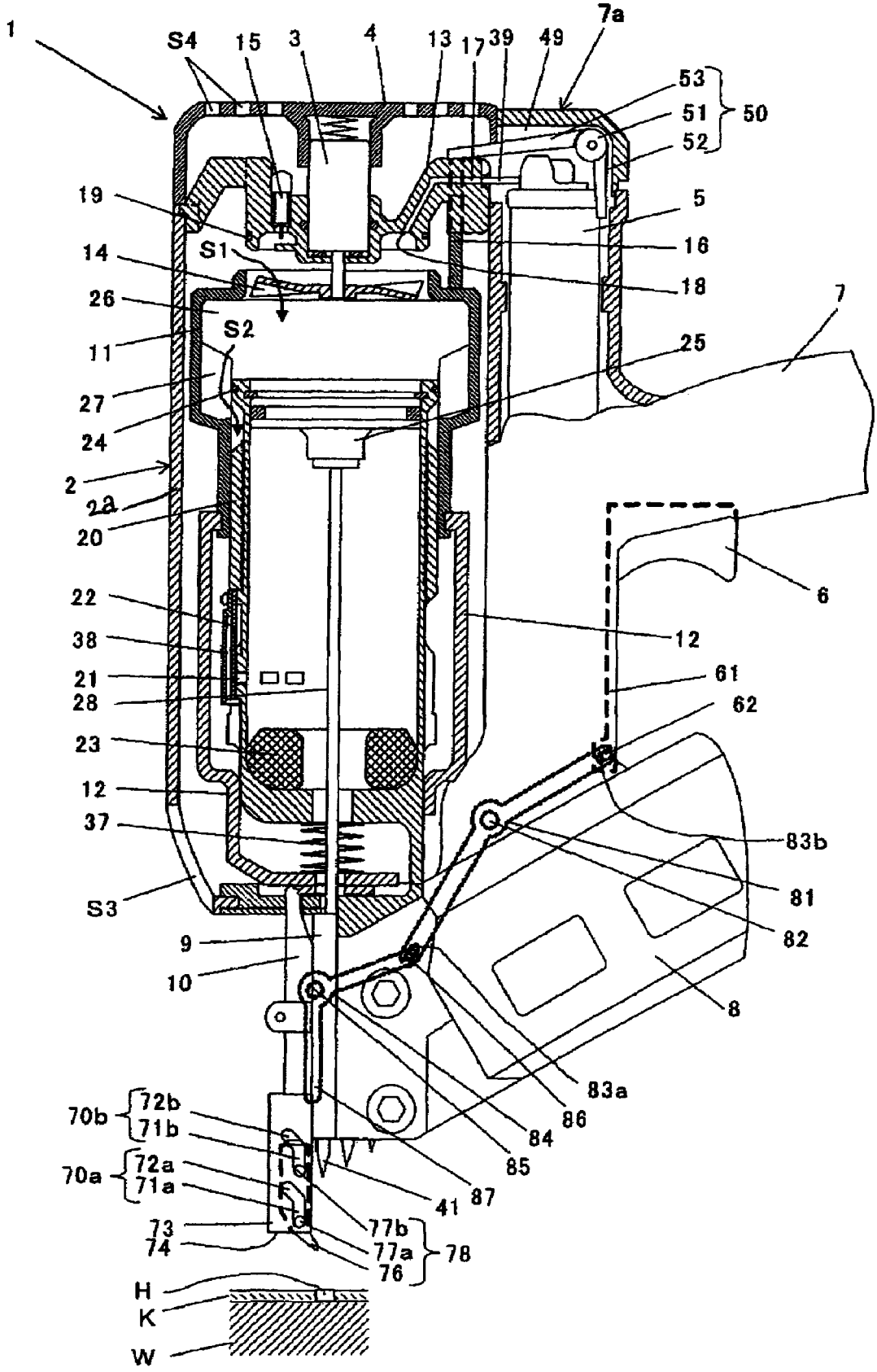
FIG. 1 is a broken section view of a combustion-type nail driving machine according to the invention, showing its initial state.
Figure 2:
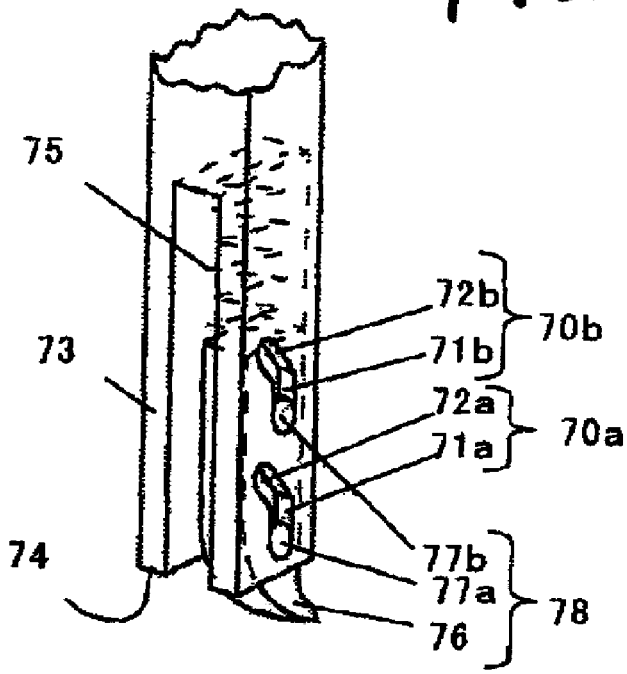
FIG. 2 is a perspective view of a nail guide mechanism part of the combustion-type nail driving machine according to the invention.
Figure 3:
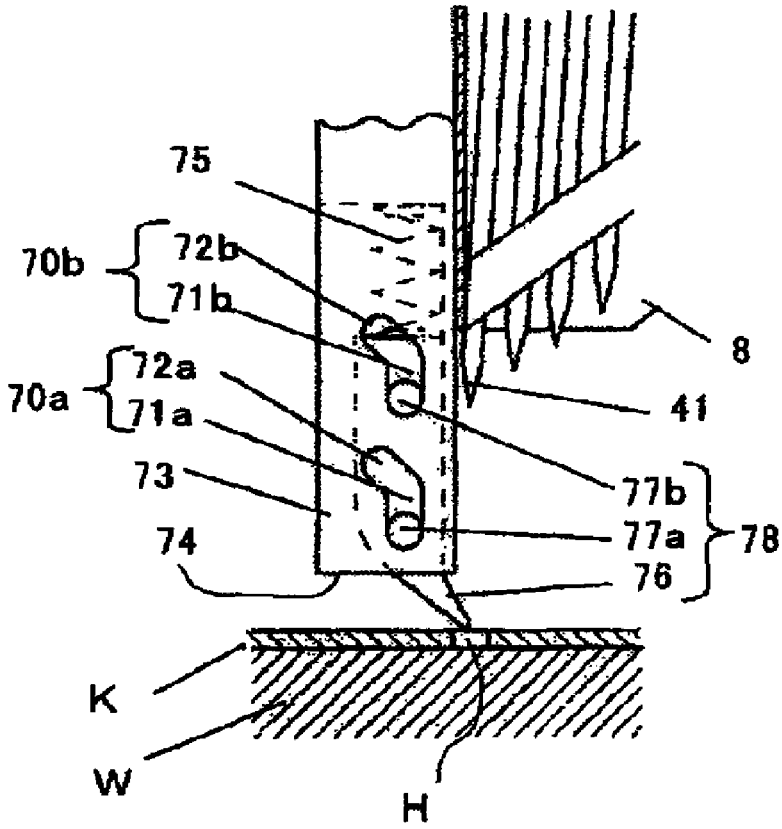
FIG. 3 is a partial section view of the nail guide mechanism part of the combustion-type nail driving machine according to the invention, showing a state just before starting to press the nail driving machine against a work.
Figure 4:
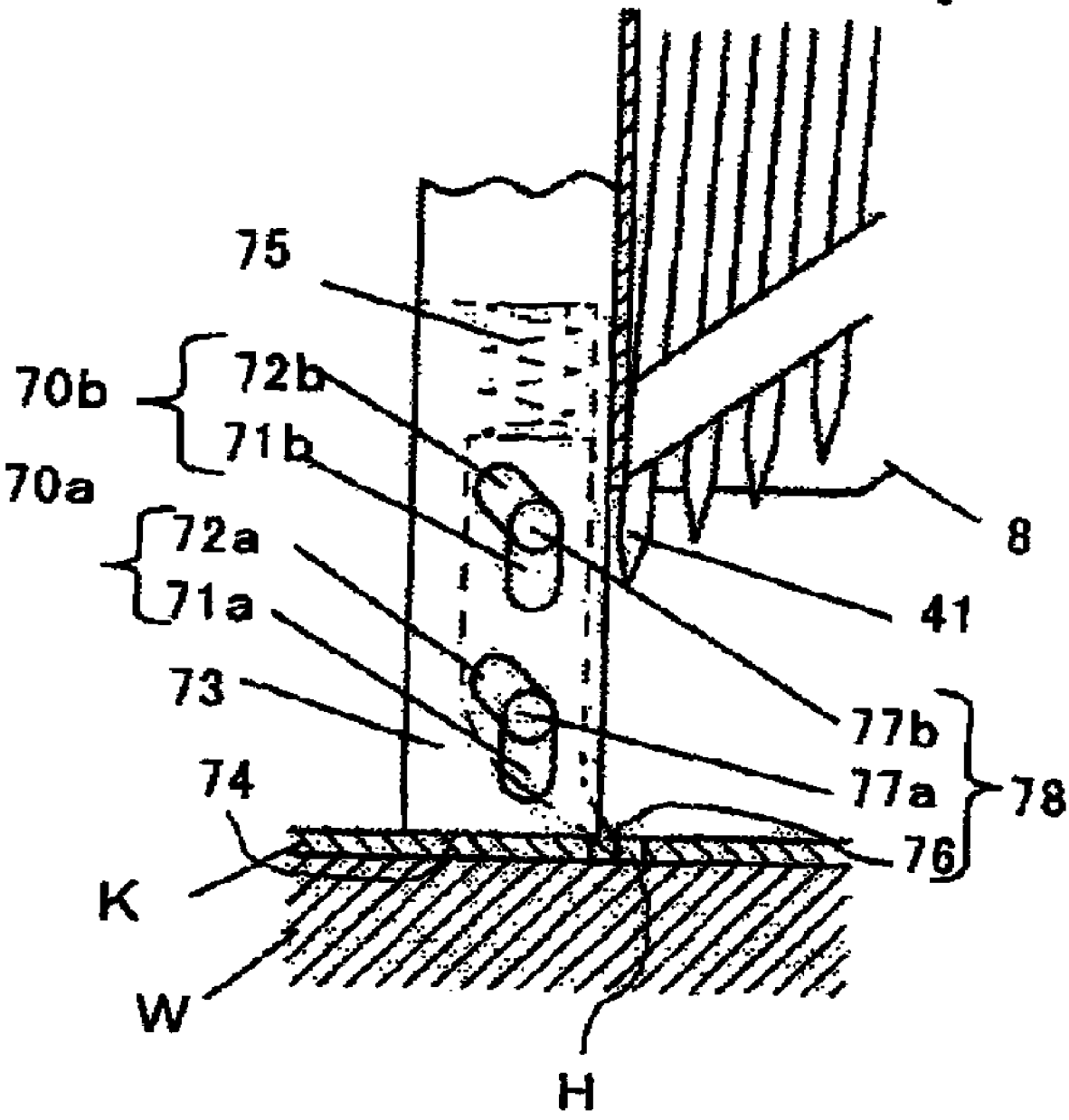
FIG. 4 is a partial section view of the nail guide mechanism part of the combustion-type nail driving machine according to the invention, showing a state in which a work contact portion is contacted with the work after pressing the nail driving machine against the work.
Figure 5:
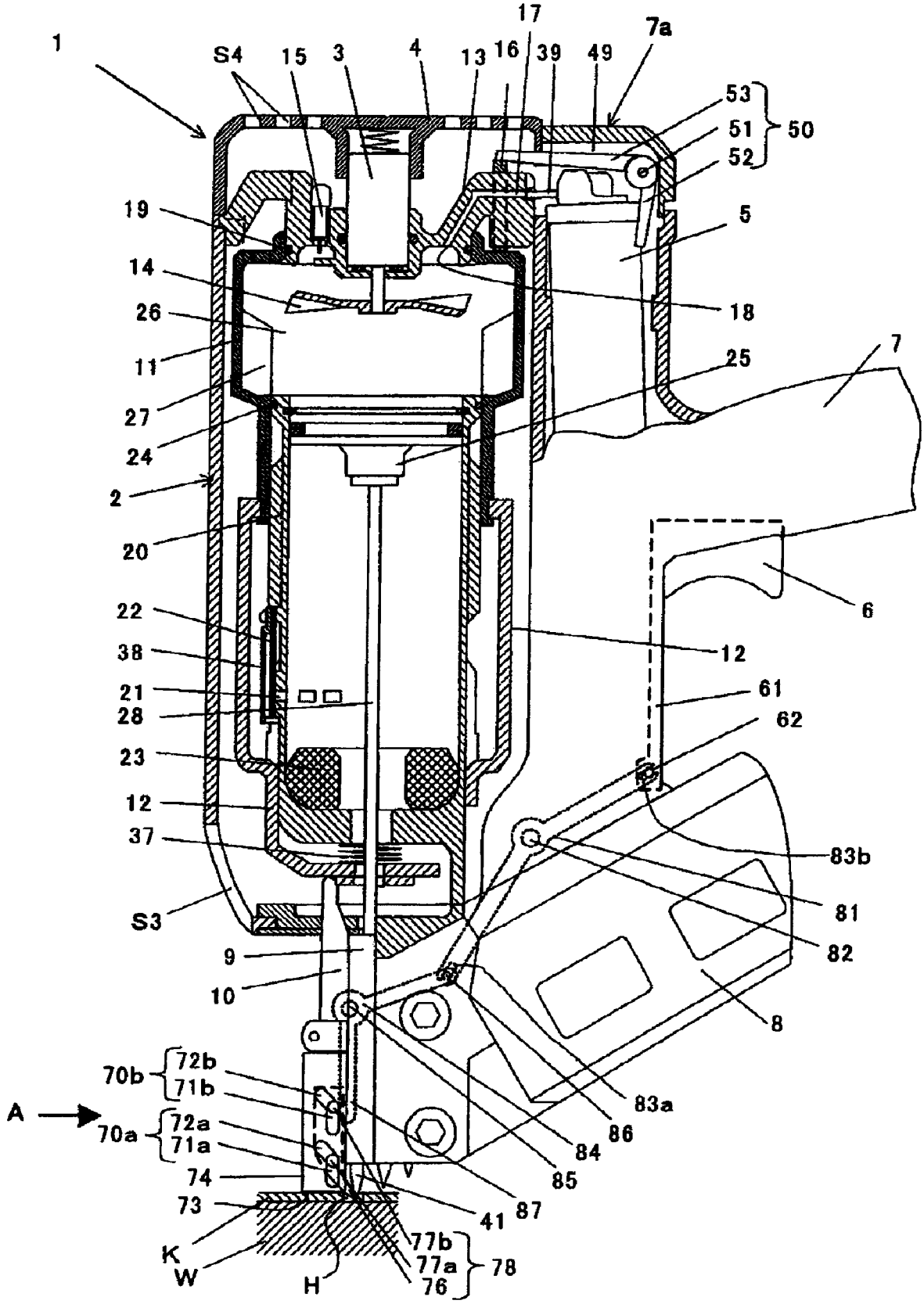
FIG. 5 is a broken section view of the combustion-type nail driving machine according to the invention, showing a state in which a nail is in contact with the work.
Figure 6:
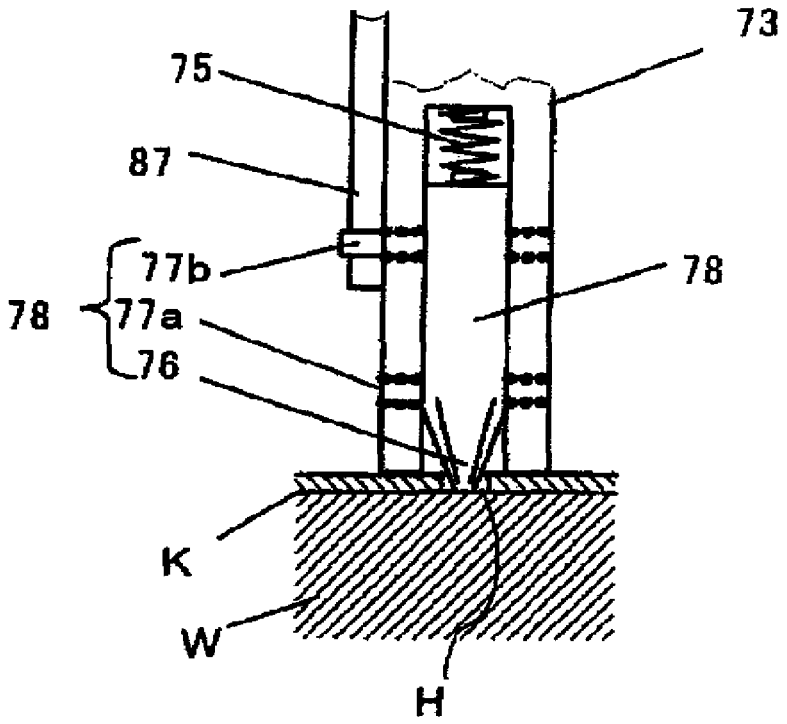
FIG. 6 is a section view taken along the arrow mark A direction shown in FIG. 5.
Figure 7:
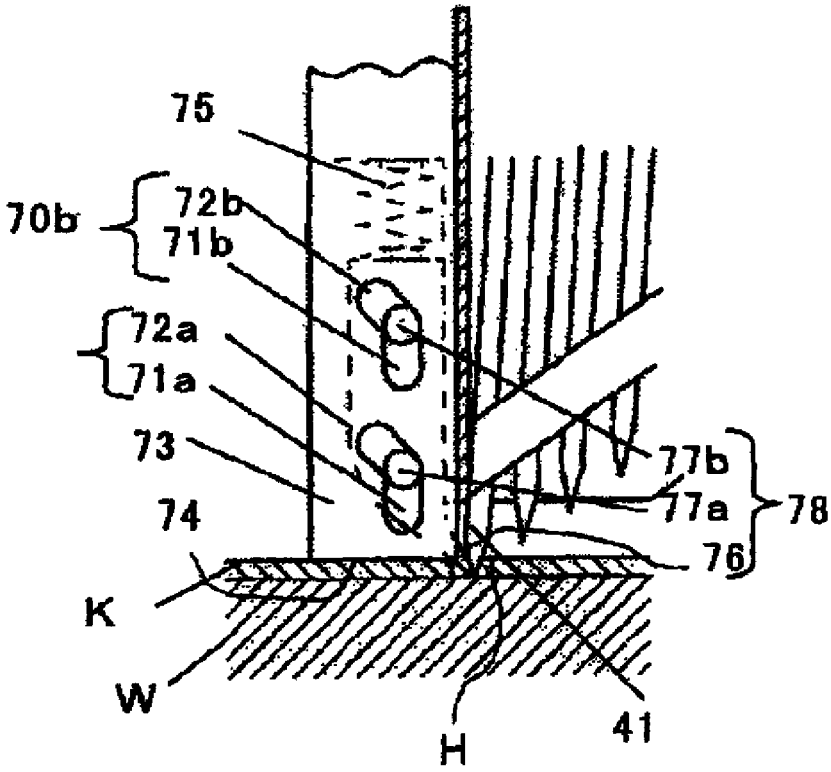
FIG. 7 is a partial section view of the nail guide mechanism part of the combustion-type nail driving machine according to the invention, showing a state in which a nail is in contact with the work.
Figure 8:
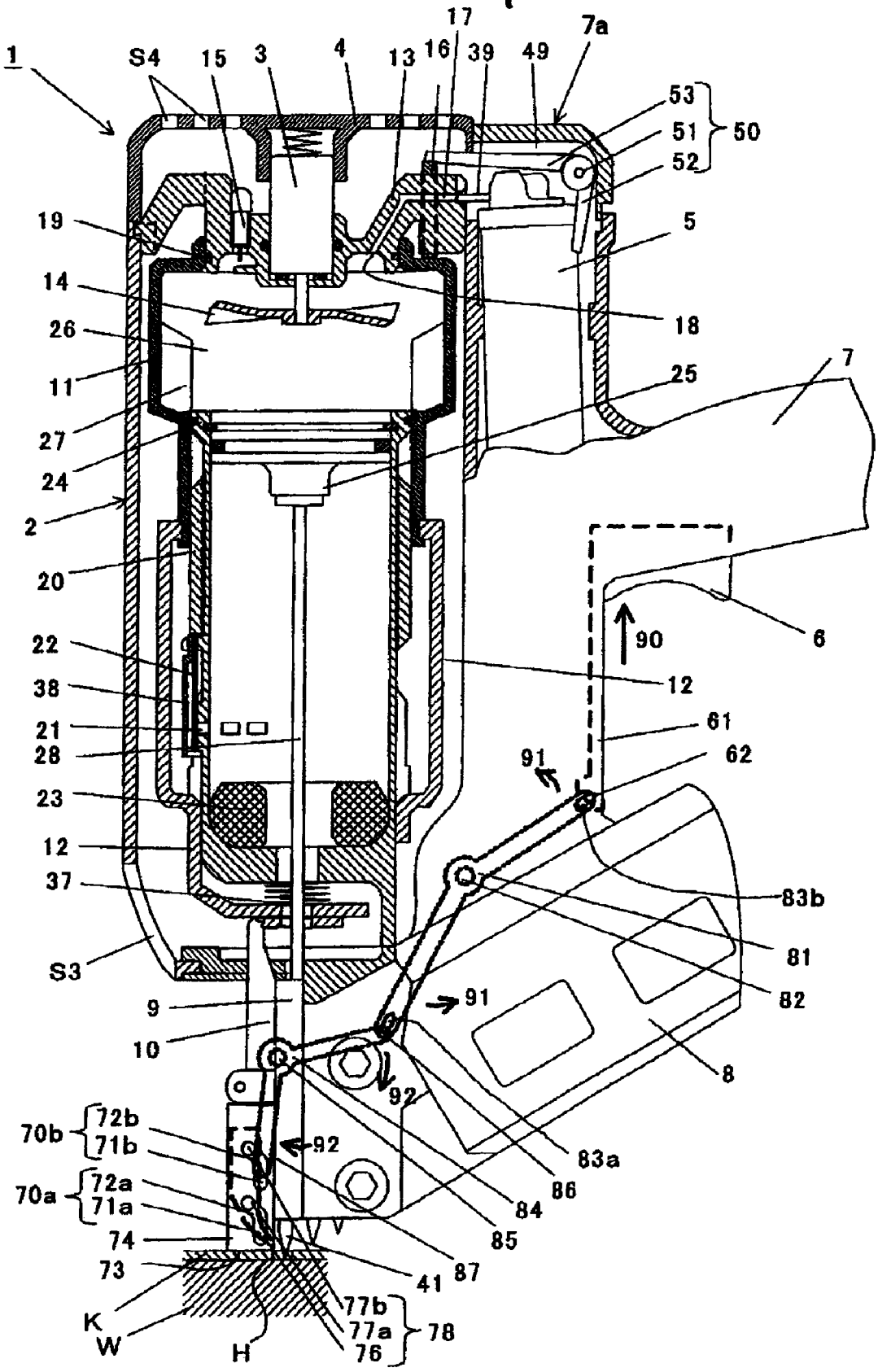
FIG. 8 is a broken side view of the combustion-type nail driving machine according to the invention, showing a state just before a nail is driven.
Figure 9:
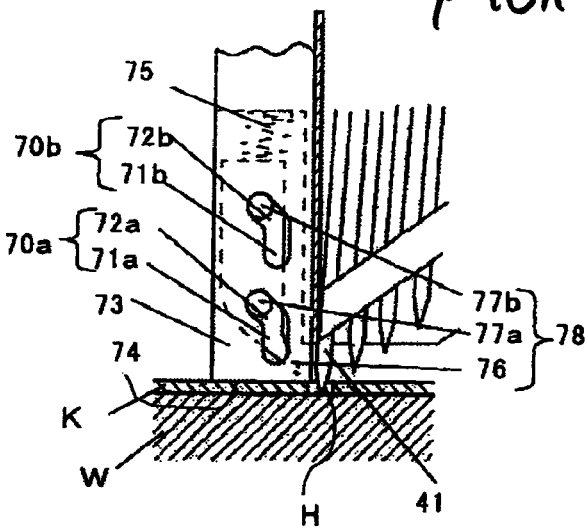
FIG. 9 is a partial section view of the nail guide mechanism part of the combustion-type nail driving machine according to the invention, showing a state just before a nail is driven.
Figure 10:
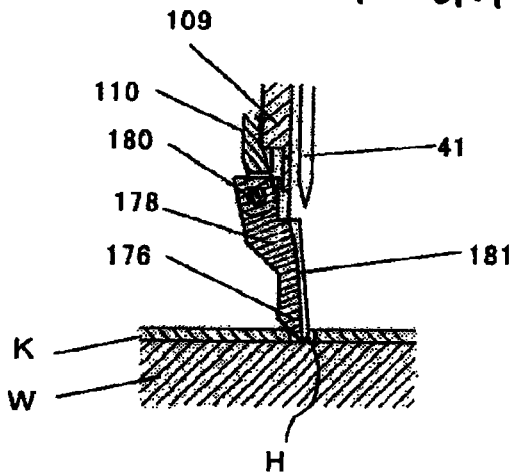
FIG. 10 is a partial section view of a conventional nail driving machine, showing a state just before a nail is driven.
Figure 11:
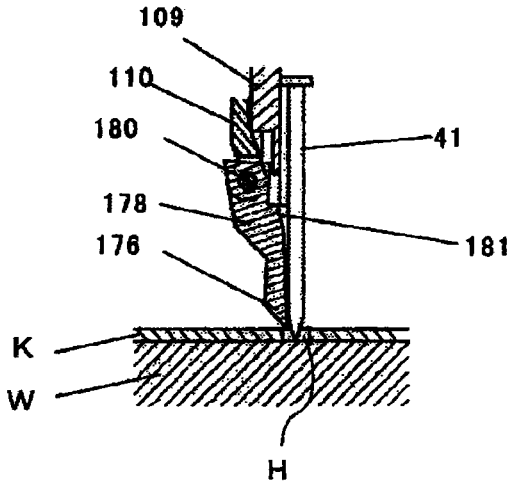
FIG. 11 is a partial section view of a conventional nail driving machine, showing a state for starting to drive a nail.

FIG. 1 is a broken section view of a combustion-type nail driving machine according to the invention, showing an initial state thereof; FIG. 2 is a perspective view of a nail guide mechanism part of the combustion-type nail driving machine; FIG. 3 is a partial section view of the nail guide mechanism part of the combustion-type nail driving machine, showing a state just before starting to press the nail driving machine against a work; FIG. 4 is a partial section view of the nail guide mechanism part of the combustion-type nail driving machine, showing a state in which a work contact portion is contacted with the work after pressing the nail driving machine against the work; FIG. 5 is a broken section view of the combustion-type nail driving machine, showing a state in which a nail is in contact with the work; FIG. 6 is a section view taken along the arrow mark A shown in FIG. 5; FIG. 7 is a partial section view of the nail guide mechanism part of the combustion-type nail driving machine, showing a state in which a nail is in contact with the work; FIG. 8 is a broken side view of the combustion-type nail driving machine, showing a state just before driving a nail; and, FIG. 9 is a partial section view of the nail guide mechanism part of the combustion-type nail driving machine, showing a state just before driving a nail.

[Whole Structure of Combustion-type Nail Driving Machine]

FIG. 1 shows the initial state of the combustion-type nail driving machine 1 before it is operated and, as shown in FIG. 1, the combustion-type nail driving machine 1 includes a housing 2 which constitutes the outer frame body of the machine 1. To the front portion of the housing 2, there is fixed a handle 7 including a gas cylinder chamber portion 7*a* which extends along the longitudinal direction of the housing 2 for mounting (setting) therein a gas cylinder 5 functioning as a fuel cell. And, on the handle 7, there is disposed a trigger switch 6.

Also, the combustion-type nail driving machine 1 further includes a magazine 8 disposed below the gas cylinder chamber portion 7*a* and the housing 2 so as to extend in the right oblique direction thereof, and a tail cover 9 for feeding and guiding a nail (a fastening member) 41 loaded into the magazine 8 to set it at a given position.

On the top portion of the main housing 2*a* of the housing 2, there is mounted a head cover 4 and, in the interior of the main housing 2*a*, there are stored the main parts of a tool assembly. That is, there are stored the following parts: a cylindrical-shaped cylinder 20 extending in the vertical direction; a chamber head 13 fixed to the housing 2 so as to cover the upper space of the upper end portion of the cylinder 20; an injection port 18 disposed in the chamber head 13 for injecting a combustible gas; an ignition plug 15 mounted on the chamber head 13; a fan motor 3 and a fan 14 respectively supported on the head cover 4 and chamber head 13; a combustion chamber frame 11 disposed movably such that it can be guided by the outer peripheral portion of the cylinder 20 and can be contacted with the chamber head 13 beyond the upper portion of the cylinder 20; a piston 25 disposed such that, in the inner peripheral portion of the cylinder 20, it can reciprocate between the upper and lower end portions of the cylinder 20; a driver blade 28 formed integral with the piston 25 for striking the nail 41 due to the downward moving operation of the piston 25 to the lower end portion of the cylinder 20 in the cylinder 20; and, a bumper 23 for absorbing a surplus impact force produced when, in order to drive the nail 41, the piston 25 (driver blade 28) is moved down to a bottom dead center within the cylinder 20 and is heavily collided with the cylinder 20.

Also, to the upper end portion of the main housing 2*a*, there is fixed the chamber head 13 and, on the chamber head 13, there is supported the fan motor 3 with the fan 14 fixed thereto by a rotation shaft; and, the ignition plug 15 to be ignited by the trigger switch 6 disposed on the handle 7 is stored into and gripped by the chamber head 13. Further, in the vicinity of the chamber head 13 within the main housing 2*a*, there is disposed a head switch (not shown), while this head switch presses the tool main body against a work (a member to be driven) W to thereby detect that the combustion chamber frame 11 is disposed in the vicinity of the upper end of the stroke. When the combustion chamber frame 11 rises further beyond a given position where the gas cylinder 5 is pressed through an L-shaped lever 50 functioning as pressing means, the head switch (not shown) is turned on to apply a voltage to the motor 3, thereby starting the rotation of the fan 14.

Further, a gas cylinder chamber portion 7*a* forms a gas cylinder chamber partition wall portion enclosing the outer peripheral portion of the gas cylinder 5 to thereby define a gas cylinder chamber 49 so that the gas cylinder 5 serving as a fuel cell can be mounted (set) removably in the gas cylinder chamber 49. In the upper portion of the gas cylinder chamber portion 2*b*, in a part of the chamber head 13 forming the gas cylinder chamber partition wall portion, there is formed a nozzle receiving port 17 which can be engaged with the injection nozzle 39 of the gas cylinder 5.

And, in the upper portion of the gas cylinder chamber portion 7*a*, there is disposed the L-shaped lever (a second link member) which includes an arm 52 to be contacted with the side of the gas cylinder 5 opposite to the injection nozzle 39, and an arm 53 to be contacted with a projection member (a first link member) 16 projected from the upper end face of the combustion chamber frame 11. The L-shaped lever 50 is supported through a shaft in the gas cylinder chamber portion 2*b* in such a manner that it can be rotated about its rotation shaft 51. Here, the projection member 16 and L-shaped lever 50 function as pressing means which presses the injection nozzle 39 of the gas cylinder 5 set in the nozzle receiving port 17 through their cooperative operations.

Within the gas cylinder 5, there is stored pressurized liquefied combustible gas; and, this gas is to be discharged to the air and to be evaporated there. In the upper end portion of the gas cylinder 5, there is disposed a valve mechanism (not shown) which is used to control the quantity of the gas to be injected from the injection nozzle 39 of the gas cylinder 5. Specifically, according to the valve mechanism, when the injection nozzle 39 of the gas cylinder 5 to be set in the nozzle receiving port 17 is pressed in the direction of the injection nozzle 39 by the pressing means including the projection member 16 and L-shaped lever 50, a given quantity of combustible gas can be injected to the injection port 18 of the chamber head 13. By the way, for the gas cylinder 5, there can be used a cylinder which is generally put on the market as a fuel cell for a combustion-type power tool.

On the other hand, downwardly of the lower end portion of the main housing 2*a*, that is, downwardly of the lower end portion of the cylinder 20, there is supported a push lever 10 in correspondence to the set position of the nail 41 in the tail cover 9 in such a manner that it can be moved upwardly along the outer peripheral portion of the tail cover 9. This push lever 10 is connected through a connecting member 12 to the combustion chamber frame 11. And, the push lever 10 and connecting member 12 are energized downwardly of the cylinder 20 by a spring 37 which functions as energizing means.

Therefore, when an operator brings a probe 78 on the leading end of the push lever 10 into contact with a work W and presses and pushes the whole of the housing 2 in the direction of the work W by an amount equivalent to the entire stroke of the push lever 10, as shown in FIG. 5, the upper end portion of the push lever 10 is moved upwardly within the main housing portion 2*a* against the downward energizing force of the spring 37 to move the combustion chamber frame 11 upwardly of the upper end portion of the cylinder 20 through the connecting member 12, thereby bringing the combustion chamber frame 11 into contact with the chamber head 13. As a result of this, as shown in FIG. 5, there is defined a combustion chamber 26 by the chamber head 13, combustion chamber frame 11 and the upper surface of the piston 25.

On the chamber head 13, there is mounted a seal member (a first seal member) 19 which is composed of an O ring or the like and is used to seal between the chamber head 13 and combustion chamber frame 11 when the upper portion of the combustion chamber frame 11 is contacted with the chamber head 13. Also, on the upper end portion of the cylinder 20, there is mounted a seal member (a second seal member) 24 composed of an O ring or the like for sealing between the inner peripheral surface of the lower portion of the combustion chamber frame 11 and the outer peripheral portion of the upper end portion of the cylinder 20 when the combustion chamber frame 11 is contacted with the chamber head 13.

The upper end portion of the combustion chamber frame 11, when the combustion chamber frame 11 is moved upwardly due to the pressing motion of the push lever 10 in the above-mentioned manner, is contacted with the lower end face of the chamber head 13 so as to form the combustion chamber 26. Almost simultaneously with this operation, because the projection member 16 is provided on the cylinder chamber portion side of the upper end face of the combustion chamber frame 11 as described above, when the combustion chamber frame 11 rises, the projection member 16 penetrates through the penetration hole of the chamber head 13 and is then contacted with the arm 53 of the L-shaped lever 50, whereby the arm 53 is pressed against the upper portion outer peripheral surface of the gas cylinder 5 opposed to the injection nozzle 39 of the gas cylinder 5. Therefore, as described above, the combustible gas can be injected from the injection nozzle 39 of the gas cylinder 5.

Also, in the vicinity of the lower end portion of the cylinder 20, there is formed an exhaust hole 21 which is in communication with the exhaust port S3 of the main housing 2*a*. And, in the exhaust hole 21, there is disposed an exhaust check valve 22 which allows the exhaust gas to flow in the direction going from the inner peripheral surface of the cylinder 20 to the outer peripheral surface thereof. Further, there is disposed an exhaust cover 38 in such a manner to cover the exhaust hole 21, while the exhaust direction of part of the combustion gas exhausted by the exhaust hole 21 is changed to the axial direction of the cylinder 2 by the exhaust cover 38. Until a given period of time passes after the explosion and combustion of the gas, the combustion chamber frame 11 is maintained in contact with the chamber head 13; when the pressure of the inside of the combustion chamber 26 is lowered due to the lowered temperature of the combustion gas within the combustion chamber 26 and also the exhaust check valve 22 is closed after exhaustion of the combustion gas, the combustion chamber 26 is closed; the pressure is lowered further to thereby provide heat vacuum; and, the piston 25 is raised due to a difference between the pressures of the upper and lower portions of the piston 25 and then can be returned to the top dead center thereof.

As described above, when the upper end portion of the combustion chamber frame 11 is contacted with the chamber head 13, there is defined the combustion chamber 26 by the chamber head 13, combustion chamber frame 11, the chamber head portion side upper end portion of the cylinder 20, the upper surface portion of the piston 25, and seal members 19, 24. On the other hand, when the combustion chamber frame 11 moves downward to part away from the chamber head 13, between the chamber head 13 and the upper end portion of the combustion chamber frame 11, there is formed a first flow passage S1 which communicates with the outside, while the first flow passage S1 acts as the suction passage of the open air. Also, between the lower end portion of the combustion chamber frame 11 and the upper end portion of the cylinder 20, there is formed a second flow passage S2 which continues with the first flow passage S1. This second flow passage S2 allows the combustion gas and new air to pass to the outer peripheral surface side of the cylinder 20, such combustion gas and air are then discharged from an exhaust port S3 which is formed in the lower end portion of the main housing portion 2*a*.

In the portion of the combustion chamber frame 11 that defines the combustion chamber 26, there are provided two or more ribs 27 which respectively project inwardly in the radial direction of the combustion chamber frame 11 in such a manner that they extend in the axial direction of the combustion chamber frame 11. These ribs 27 are used to, in cooperation with the rotation of the fan 14, accelerate the stirring and mixing of the air from the outside with the combustible gas from the gas cylinder 5 within the combustion chamber 26. Suction ports S4, which are formed in the head cover 4, are used to supply the air into the combustion chamber 26, whereas, from the exhaust hole 21 and exhaust port S3, there is discharged the combustion gas of the combustion chamber 26.

The driver blade 28 for driving the nail 41 extends from the lower surface portion of the piston 25 toward the lower end portion direction of the cylinder 20 and is present at a coaxial position where it can impact on the nail 41 set within the tail cover 9. The piston 25, when it lowers down, butts against the bumper 23 and is thereby caused to stop.

The fan 14, ignition plug 15 and gas injection port 18, which are provided in the chamber head 13, are all disposed within or are all opened to the combustion chamber 26 which can be defined by the upward movement of the combustion chamber frame 11. When the combustion chamber frame 11 is present at a position for contact with the chamber head 13, the fan 14 stirs and mixes together the air and combustible gas due to its rotation prior to ignition; after ignition, the fan 14 causes turbulent combustion to thereby accelerate combustion; and, when the combustion chamber frame 11 parts away from the chamber head 13 and the first and second flow passages S1 and S2 are thereby formed, the fan 14 scavenges the combustion gas within the combustion chamber 26 and also cools the combustion chamber frame 11 and cylinder 20. That is, the fan 14 has the above-mentioned three functions.

[Structure of Nail Positioning Mechanism]

Next, description will be given below of a nail positioning mechanism which constitutes the subject matter of the invention.

The end face 74 of a work contact portion 73 existing in the leading end portion of the push lever 10 energized by the spring 37 is formed as a plane and, within the work contact portion 73, there is stored the probe 78 in such a manner that, in the embodiment shown in the drawings, it can be moved vertically and horizontally. This probe 78 includes a sharp angle tapered leading end portion 76 and is energized downward in the shown embodiment by a spring 75 (see FIGS. 2~4) which functions as energizing means; and, in a state where the present combustion-type nail driving machine 1 is pressed against the work W, as shown in FIGS. 1 to 3, the leading end portion 76 of the probe 78 is projected from the end face 74 of the work contact portion 73 downwardly toward the driving passage of the nail 41. Here, the spring constant of the spring 75 is set smaller than the spring constant of the above-mentioned spring 37.

In the side surface of the work contact portion 73, there are formed two guide grooves 70*a* and 70*b* in two upper and lower stages, each of which has a dogleg shape when it is viewed from the side surface thereof. With these guide grooves 70*a* and 70*b*, there are respectively engaged guide projections 77*a* and 77*b* which are provided on the side surface of the probe 78. Here, the guide grooves 70*a* and 70*b* are respectively composed of axial-direction portions 71*a*, 71*b* and inclined portions 72*a*, 72*b*.

In the magazine 8, there are loaded two or more nails 41 which are connected together by a connecting belt, at least the leading end of the leading nail 41 fed to the tail cover 9 acting as the nail driving portion is projected from the end portion of the tail cover 9, and the position of the leading end of the nail 41 is situated upwardly of the end face 74 of the work contact portion 73 by a dimension equivalent to the stroke of the push lever 10. Also, the leading end of the nail 41 is situated on the axis of the leading end portion 76 of the probe 78.

Also, a lever 84, which has a dogleg shape when viewed from its side surface and constitutes transmission means, is rotatably supported by a shaft 85. On this lever 84, as shown in FIGS. 5 and 6, there is provided an engaging arm 87 which, when the push lever 10 and probe 78 move upward by an amount equivalent to the strokes thereof, can be engaged with the guide projection 77*b* of the probe 78.

Further, on the main body of the present nail driving machine 1, there is supported another lever 81, which has a dogleg shape when viewed from its side surface and constitutes the transmission means, is rotatably supported at its middle portion by a shaft 82. One end of the lever 81 is connected to the end portion (the end portion opposite to the engaging arm 87) of the lever 84 by a pin 86 which can be engaged with a split groove 83*a*, whereas the other end of the lever 81 is connected to the end portion of an arm 61 of the trigger switch 6 by a pin 62 engageable with a split groove 83*b*.

By the way, according to the present embodiment, as described above, as the transmission means for transmitting the operation of the trigger switch 6 to the probe 78, there are used the levers 81 and 84. However, instead of them, it is also possible to use a solenoid or the like.

[Operation of Nail Positioning Mechanism]

From the initial state shown in FIG. 1, as shown in FIG. 3, while the probe 78 is aligned with the hole H of the connecting metal member K with the leading end portion 76 of the probe 78 as a guide, the pressing of the present combustion-type nail driving machine 1 is started. Thus, firstly, in a state where the tapered leading end portion 76 of the probe 78 is inserted in the hole H of the connecting metal member K, the leading end of the probe 78 is butted against the work W, the spring 75 having a small spring constant is firstly compressed, and the probe 78 is inserted into the work contact portion 73 along the axial-direction portions 71*a* and 71*b* of the guide grooves 70*a* and 70*b* of the work contact portion 73, whereby the projecting amount of the leading end portion 76 of the probe 78 from the end face 74 of the work contact portion 73 decreases. When the projecting amount of the leading end portion 76 of the probe 78 reaches the depth of the hole H of the connecting metal member K, as shown in FIG. 4, the end face 74 of the work contact portion 73 is contacted with the surface of the connecting metal member K.

When the combustion-type nail driving machine 1 is pressed further from the above state, because the end face 74 of the work contact portion 73 is in contact with the surface of the connecting metal member K, there is maintained the state in which the leading end portion 76 of the probe 78 is inserted in the hole H of the connecting metal member K, and the push lever 10, connecting member 12 and combustion chamber frame 11 rise against the energizing force of the spring 37. And, when the present combustion-type nail driving machine 1 is pressed until the push lever 10 reaches the top dead center, as shown in FIGS. 5~7, the leading end of the nail 41 moves into the hole H of the connecting metal member K and the leading end of the nail 41 is engaged with the leading end of the probe 78 within the hole H of the connecting metal member K, whereby the nail 41 is positioned. During this operation, since the tapered leading end portion 76 of the probe 78 is caught by the hole H of the connecting metal member K, the combustion-type nail driving machine 1 is prevented from shifting in position, thereby being able to maintain the aligned and engaged state of the leading end of the nail 41 with the hole H of the connecting metal member K.

On the other hand, the combustion chamber 26 is hermetically closed with respect to the open air, the projection member 16 on the upper surface of the combustion chamber frame 11, in the vicinity of the top dead center of the moving stroke, is contacted with the arm 53 of the L-shaped lever 50 through the penetration hole of the chamber head 13, and the arm 52 is pressed against the upper portion outer peripheral surface of the gas cylinder 5 disposed opposed to the injection nozzle 39 of the gas cylinder 5. Owing to this, the combustible gas is injected from the injection nozzle 39 of the gas cylinder 5 into the combustion chamber 26. After then, the fan 14 rotates to stir and mix together the air and combustible gas within the combustion chamber 26.

When starting to draw the trigger switch 6 in the arrow mark 90 direction shown in FIG. 8 from the above state, firstly, as shown in FIGS. 8 and 9, the trigger switch 6 and arm 61 move upward integrally and the lever 81 is rotated about the shaft 82 in the arrow mark 91 direction (counterclockwise). As a result of this, the lever 84 with one end connected to the lever 81 by the pin 86 is rotated about the shaft 85 in the arrow mark 92 direction (clockwise), and the engaging arm 87 of the lever 84 pushes up the guide projection 77*b* of the probe 78 obliquely upwardly along the inclined portion 72*b* of the guide groove 70*b* of the work contact portion 73. Therefore, the probe 78 translates obliquely upwardly, the leading end portion 76 of the probe 78 parts and retreats from the hole H of the connecting metal member K and the leading end of the nail 41, and the probe 78 is drawn into the work contact portion 73. As a result of this, while only the leading end of the nail 41 is caught in the hole H of the connecting metal member K, the combustion-type nail driving machine 1 is positioned by the nail 41.

When the trigger switch 6 is drawn further from the above state, the ignition plug 15 is ignited at the top dead center of the trigger switch 6, and the mixture within the combustion chamber 26 is exploded and combusted. Owing to this explosion and combustion, the piston 25 is driven downward and, until the piston 25 is butted against the bumper 23, the nail 41 is driven accurately into the work W through the hole H of the connecting metal member K by the driver blade 28. At the then time, because the probe 78 retreats in the lateral direction completely from the driving passage of the nail 41, the probe 78 is prevented from colliding with the nail 41 to thereby avoid a possibility that the probe 78 can be broken by an impact load, so that the life of the probe 78 can be extended.

Also, prevention of the probe 78 against breakage eliminates the need to stop the nailing operation for repair of the probe 78 and replace the probe 78 with a new one using other hand-operated tool. This can enhance the operation efficiency of the present combustion-type nail driving machine and also can reduce the cost of the part replacement thereof. Especially, since the retreat of the probe 78 from the hole H of the connecting metal member K can be completed before the driving of the nail 41 is started by operating the trigger switch 6, the nail 41 can be positively prevented against contact with the probe 78 during the driving operation of the nail 41.

Also, according to the present embodiment, since the guide grooves 70*a* and 70*b* are arranged in two stages in the driving direction in the work contact portion 73, the probe 78 can be moved parallel to the driving direction and thus the probe 78 can be positively retreated from the hole H of the connecting metal member K. And, by moving the probe 78 along the guide grooves 70*a* and 70*b* in linking with the operation of the trigger switch 6 in the nail driving operation, the probe 78 can be retreated from the hole H of the connecting metal member K, which makes it possible to enhance the nail driving operation efficiency of the nail driving machine.

Further, according to the present embodiment, since the spring constant (energizing force) of the spring 75 for energizing the probe 78 is set smaller than the spring constant (energizing force) of the spring 37 for energizing the push lever 10, simply by operating the trigger switch 6 lightly with a finger, the probe 78 can be moved and retreated from the hole H of the connecting member K.

After then, when the piston 25 passes downwardly through the exhaust hole 21 of the cylinder 20, the exhaust check valve 22 is energized by the pressure of the combustion gas to open the exhaust hole 21, and the combustion gas is discharged to the outside of the cylinder 20 and is then discharged from the exhaust port S3 of the main housing portion 2*a* to the outside. And, at the time when the combustion gas is discharged to the outside of the cylinder 20 and the pressure of the inside of the cylinder 20 and combustion chamber 26 reaches the atmospheric pressure, the exhaust check valve 22 is closed. The combustion gas remaining in the inside of the cylinder 20 and the combustion chamber 20 is high in temperature because after it is combusted; but, the heat of the combustion gas is absorbed from the inner peripheral wall of the cylinder 20 and the inner peripheral wall of the combustion chamber frame 11 to thereby cool the combustion gas rapidly, so that the pressure of the closed space of the upper portion of the piston 25 lowers down to or less than the atmospheric pressure. Owing to this, the pressure (atmospheric pressure) within the cylinder 20 on the driver blade 28 side with the piston 25 as the boundary thereof is higher than the inner pressure of the cylinder 20 on the combustion chamber 26 side, whereby the piston 25 is pulled back to the initial top dead center position.

And, after the whole of the combustion-type nail driving machine 1 is lifted up from the work W and the push lever 10 is separated from the work W, when the trigger switch 6 is turned off, the push lever 10 and combustion chamber frame 11 are moved downward and returned to their original positions by the energizing force of the spring 37, and the probe 78 is also moved downward and returned to its original position by the energizing force of the spring 75. When the combustion chamber frame 11 is lowered down to its original position, there are formed the flow passages S1 and S2. The continuous rotation of the fan 14 allows not only the flow passage S1 to provide a suction passage for sucking the air into the combustion chamber 26 but also the flow passage S2 to provide an exhaust passage from the combustion chamber 26, and scavenges the residual combustion gas within the combustion chamber 26 to replaces it with the fresh air, thereby returning the nail driving machine 1 to a state in which the next nail 41 can be driven.

By the way, according to the present embodiment, although the guide grooves 70*a* and 70*b* for guiding the probe 78 are formed in the work contact portion 73, they may also be formed in the probe 78 itself.

Although description has been given heretofore of the invention with reference to the embodiment thereof in which the invention is applied to a combustion-type nail driving machine, the invention is not limited to the above embodiment but various changes and modifications are also possible without departing from the scope of the subject matter of the invention. For example, the invention can also be applied to pneumatic or electric nail driving machines and other driving machines than the nail driving machines.

What is claimed:

1. A driving machine for driving a fastening member into a member to be driven by operating a trigger switch, comprising:

a push lever movable in a driving direction;

first energizing means for energizing the push lever in the driving direction, a contact portion including an end face to be contacted with a member to be fastened provided on the push lever, a probe movably provided in the contact portion, second energizing means for energizing the probe in the driving direction to thereby project its leading end portion from the end face of the contact portion along the axis of a driving passage of the fastening member, and transmission means connecting the trigger switch to the probe, and wherein, in a state where the main body of the driving machine is pressed against the member to be driven, and when the trigger switch is operated, the probe is retreated from the driving passage of the fastening member by the transmission means.

2. The driving machine as set forth in claim 1, wherein a guide groove is formed in the contact portion, and the probe is moved parallel to the driving direction along the guide groove with respect to the contact portion and is moved obliquely to thereby retreat the probe from the driving passage of the fastening member.

3. The driving machine as set forth in claim 1, wherein a guide groove is formed in the probe, and the probe is moved parallel to the driving direction along the guide groove with respect to the contact portion and is moved obliquely to thereby retreat the probe from the driving passage of the fastening member.

4. The driving machine as set forth in claim 2, wherein the guide groove is composed of two guide grooves formed in the driving direction.

5. The driving machine as set forth in claim 2, wherein, by transmitting the operation of the trigger switch to the probe through the transmission means, the probe is moved along the guide grooves.

6. A driving machine as set forth in claim 1, wherein the retreat of the probe from the driving passage of the fastening means is completed before starting to drive the fastening means by operating the trigger switch.

7. A driving machine as set forth in claim 1, wherein the energizing force of the second energizing means for energizing the probe is smaller than the energizing force of the first energizing means for energizing the push lever.

* * * * *